US005971140A

United States Patent [19]

Frutin

[11] Patent Number: 5,971,140

[45] Date of Patent: Oct. 26, 1999

[54] APPARATUS FOR MIXING A FLUID AND A LIQUID

[75] Inventor: Bernard Derek Frutin, Renfrewshire, United Kingdom

[73] Assignee: Rocep Lusol Holdings Limited, Renfrew, United Kingdom

[21] Appl. No.: 09/000,401

[22] PCT Filed: Jul. 29, 1996

[86] PCT No.: PCT/GB96/01803

§ 371 Date: Jan. 28, 1998

§ 102(e) Date: Jan. 28, 1998

[87] PCT Pub. No.: WO97/05039

PCT Pub. Date: Feb. 13, 1997

[30] Foreign Application Priority Data

Jul. 29, 1995 [GB] United Kingdom ..... 9515637
Dec. 2, 1995 [GB] United Kingdom ..... 9524694

[51] Int. Cl.[6] ..... B65D 25/00

[52] U.S. Cl. ..... 206/222; 215/DIG. 8

[58] Field of Search ..... 206/219, 222, 206/220, 221; 215/DIG. 8

[56] References Cited

U.S. PATENT DOCUMENTS 3,856,138 12/1974 Maekawa et al. .
5,038,951 8/1991 Rizzardi ..... 206/222
5,543,097 8/1996 Fang ..... 206/222

FOREIGN PATENT DOCUMENTS 2153519 5/1973 France .
2507735 12/1982 France .
2220930 1/1990 United Kingdom .

*Primary Examiner*—Jacob K. Ackun
*Attorney, Agent, or Firm*—Ratner & Prestia

[57] ABSTRACT

A first container (60) contains a first liquid. The first container includes an opening which is closed by a releasable closure (61) and a second container (20) located in the first container (60) adjacent the opening of the first container (60). The second container (20) contains a fluid (15,16) and the second container (20) is adapted to release the fluid (15,16) into the first container (60) and into contact with the first liquid on release of the closure (61) from the first container (60).

10 Claims, 2 Drawing Sheets

APPARATUS FOR MIXING A FLUID AND A LIQUID

The invention relates to apparatus for introducing a fluid into a first liquid and especially a container which introduces the fluid into the first liquid on opening of the container.

In a wide number of applications, such as pharmaceuticals for both human and animal use, agrochemicals and other more general applications it may be necessary to release and mix a liquid catalyst or reagent into a liquid before the liquid may be used. Conventional methods involve a user measuring out the liquid catalyst or reagent and then adding it to the main liquid. This may cause problems in that it is prone to human error in the measuring of the amount of liquid catalyst or reagent and may also be hazardous if the catalyst or reagent is toxic.

In accordance with the present invention, apparatus for introducing a fluid into a first liquid comprises a first container for containing the first liquid, the first container having an opening closed by a releasable closure, and a second container located in the first container adjacent the opening of the first container; the second container comprising an outer housing located in the opening and an inner container containing a fluid, the inner container being movably mounted in the housing for movement between a closed position in which the inner container is sealed by the housing when the releasable closure closes the opening, and an open position in which the fluid within the inner container is released from the inner container into the first container and into contact with the first liquid on release of the releasable closure.

An advantage of the invention is that by using a second container located adjacent the opening of the first container and adapted to release a fluid into the first container and into contact with the first liquid on release of the closure, it is possible to introduce the fluid into the first liquid without requiring direct handling of the fluid by a user.

Preferably, the second container may include a conduit into which the fluid passes on release of the closure and the conduit extends below the surface of the first liquid in the first container. Typically, the conduit extends to at least adjacent the mid-section of the first liquid in the first container and preferably, extends to adjacent the bottom of the first container.

Typically, the fluid may be a gas and/or a second liquid. The fluid may be pressurised to aid expulsion of the fluid from the second container on release of the closure. Typically, where the second container comprises an outer housing and an inner container, pressurised gas is located in the inner container with the second liquid.

Preferably, the inner container includes a rupturable member and the housing includes a rupturing member to rupture the rupturable member on the inner container. Typically, the rupturable member may be a membrane.

Preferably, the inner container is located in an initial position prior to insertion into the container and on closing of the first container by the closure moves the inner container to the closed position. Typically, the second container also includes a sealing device and when the inner container is in the closed position the rupturing member has ruptured the rupturable member of the inner container but the contents of the inner container are prevented from being released from the inner container by the sealing member. Typically, the sealing member is attached to the inner container and seals against the rupturing member on the housing. When the inner container moves to the open position the seal member no longer prevents release of the fluid from the inner container.

Preferably, the first and second liquids may be any combination of liquids. Examples of first and second liquids are pharmaceutical liquids, agrochemical liquids and any other combination of liquids which requires a second liquid to be added to a first liquid prior to use of the liquid mixture.

An example of a container for introducing a fluid into a first liquid in accordance with the invention will now be described with reference to the accompanying drawings, in which.

Figure 1:
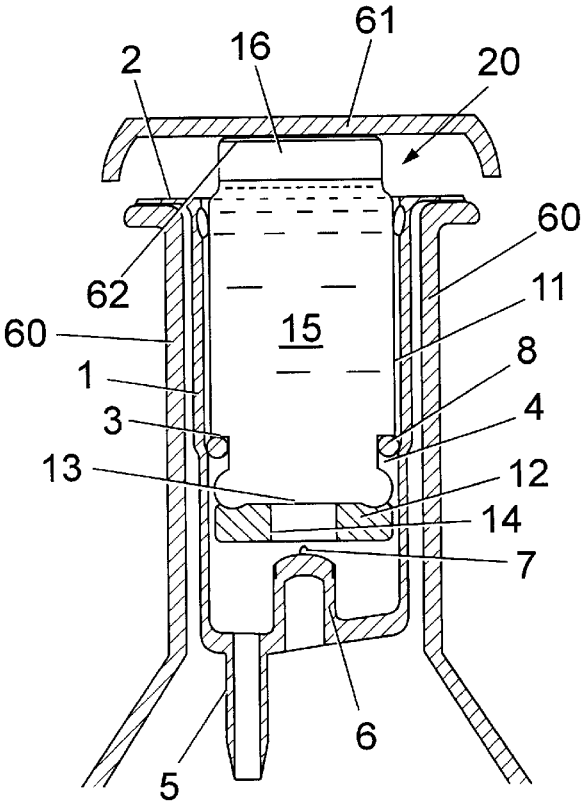
FIG. 1 is a cross-sectional view of a first example of a second container in a shipping or storage position.

FIG. 1 shows a second container 20 which comprises an outer housing 1 which has an upper lip 2. Extending from the bottom of the housing 1 is a dip tube connector 5. The housing 1 has a rupturable member 6 which extends upwards and terminates in a spike 7. A dip tube (not shown) may be attached to the connector 5, if desired.

In the side wall of the housing 1 is a ridge 3 which extends circumferentially around the inside of the housing 1.

An inner container 11 has a lower open end which is sealed by a sealing gasket 12 and a rupturable membrane 13. The gasket 12 is annular and defines a central aperture 14. The container 11 also has an O-ring seal 8 encircling it in a circumferential recess 4 in the container 11.

In use, the inner container 11 is filled with a liquid 15 and a pressurised gas 16 by means of conventional technology used to fill pressurised dispenser packs, commonly known as aerosol containers. The inner container 11 is then inserted into the outer housing 1 and pushed into the outer housing 1 until the O-ring 8 engages with the ridge 3. This position is shown in FIG. 1. In this position the membrane 13 is above the member 6 and spike 7.

The outer housing 1 and the inner container 11 are then inserted into the opening of a container 60, the outer housing 1 fits inside the opening and the dip tube (if fitted) extends into a first liquid in the container 60. The outer housing 1 is supported in the opening by the upper lip 2 which rests on the top of the opening. A closure 61 such as a threaded cap is then applied to the container 60 to close the container. On application of the closure 61 to the first container 60, the inner container 11 is moved downwards and moves to the position shown in FIG. 2. An adhesive section 62 may be provided on the top end of the container 11 and serves to attach the top end of the container 11 to the inside of the closure 61 when the closure 61 is applied to the container.

Figure 2:
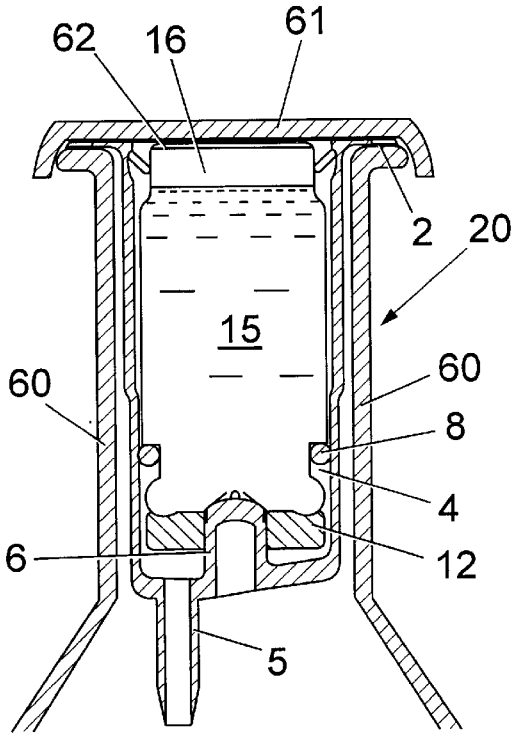
FIG. 2 is a cross-sectional view of the second container of FIG. 1 showing the position of the second container when located in a first container and the first container opening is closed.

When the closure 61 is applied to the first container 60, the inner container 11 moves to the position shown in FIG. 2. When this happens, the spike 7 bursts the rupturable membrane 13 and the member 6 extends into the aperture 14 in the gasket 12. In this position the liquid 15 and gas 16 are prevented from escaping from the inner container 11 by the gasket 12 and member 6 which seal against each other to prevent release of the liquid 15 and gas 16 from the container 11.

The inner container 11 remains in the position shown in FIG. 2 until a user releases the closure 61 from the first container 60. When this occurs, the inner container 11 moves to the position shown in FIG. 3. In this position the gasket 12 becomes unsealed from the member 6 and liquid 15 is forced out of the container 11 by the pressurised gas 16 in the direction of arrows 17 and into the dip tube connector 5. The liquid 15 then passes through the dip tube 5 and into the first liquid 23 in the first container 60, via the dip tube if fitted. On removal of the closure 61, the housing 1, inner container 11 and dip tube (if fitted) are removed from the first container 60 because the inner container 11 is attached to the closure 61 by adhesive 62. The liquid 15 enters the first liquid through the dip tube connector 5 and dip tube (if fitted) before the housing 1, inner container 11 and dip tube (if fitted) are removed from the first container 60. Liquid is prevented from passing up between the housing 1 and the inner containers 11 by the O-ring 8.

Figure 3:
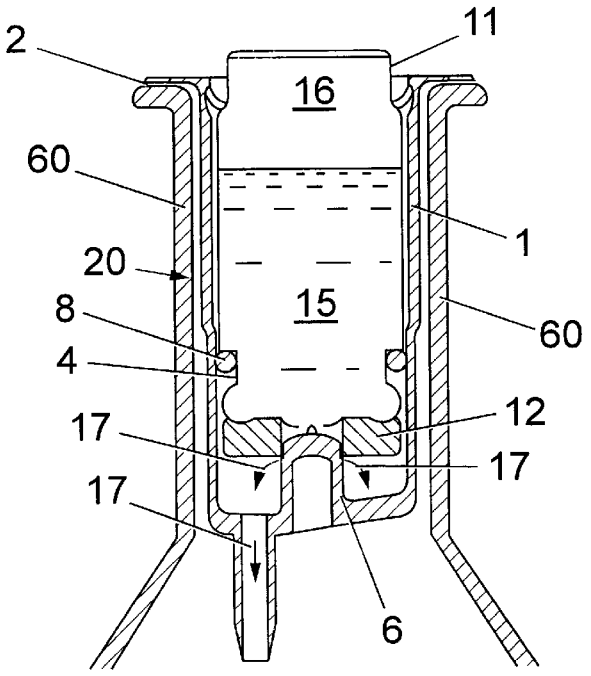
FIG. 3 is a cross-sectional view of the second container of FIG. 1 showing the position of the second container when the closure on the first container is released.

It is possible that upward movement of the container 11 from the position shown in FIG. 2 to the position shown in FIG. 3 could be aided by a spring located between the gasket 12 and the bottom of the outer housing 1.

Hence, the container 11 may move to the position shown in FIG. 3 by use of a spring and/or by means of the pressure within the container 11 which reacts against the member 6 to push the inner container 10 to the position shown in FIG. 3.

Figure 4:
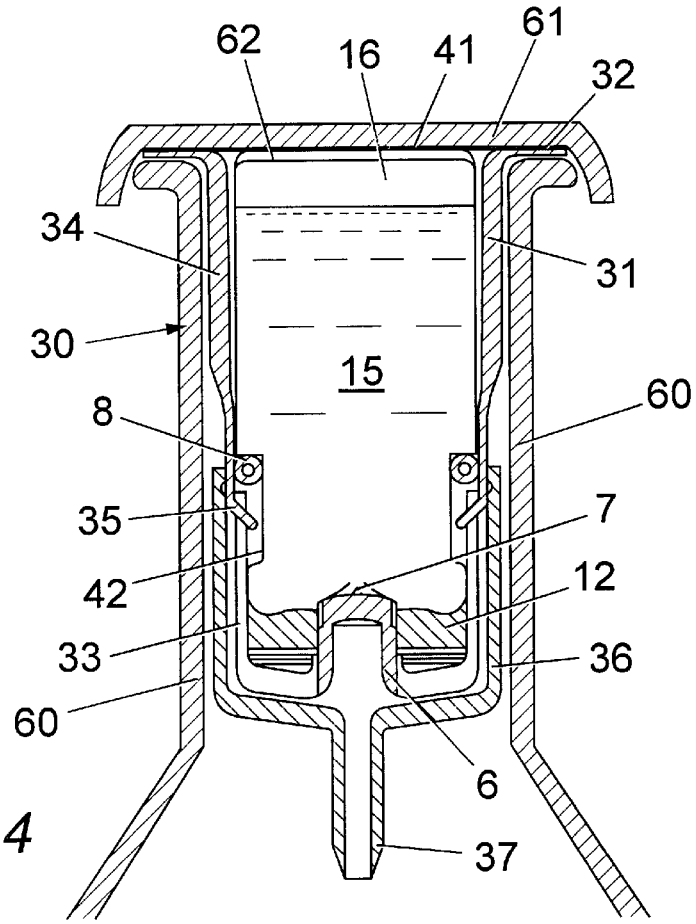
FIG. 4 is a cross-sectional view of a second example of a second container when located in a first container and the first container opening is closed.

A second example of a second container 30 is shown in FIG. 4. In the container 30, an inner container 41 is similar to the container 11 shown in FIGS. 1 to 3 and also has an O-ring 8. The main difference is that recess 42 is extended compared to the recess 4 in inner container 11.

However, outer housing 33 is different to the outer housing 1. The housing 31 comprises an upper lip 32 which is connected to a lower portion 33 by arm portions 34. The lower ends of arm portions 34 form protruding nibs 35 which engage in the recess 42. Over the end of the lower portion 33 is a dip tube adaptor 36 which has a connector 37 to which a dip tube may be fitted, if desired. The adaptor 36 may be secured to the lower portion 33 by glue or by a snap connection.

In use, the second container 30 operates and is used in a similar manner to the second container 20. The adaptor 36 directs the liquid 15 as it flows out of the inner container 41 into the liquid in the first container 60, via the dip tube if fitted.

Figure 5:
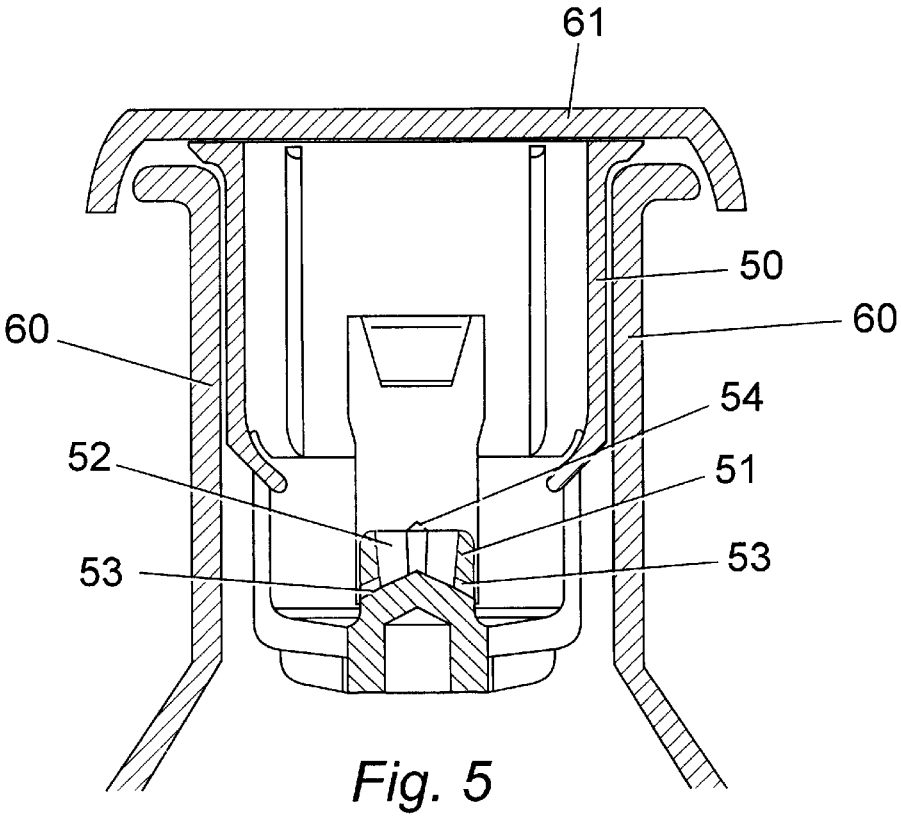
FIG. 5 is a cross-sectional view through an outer housing for a third example of a second container.

An example of a modified outer housing 50 is shown in FIG. 5. The outer housing 50 is similar to the outer housings 1, 31. The main differences are that there is a central portion 51 which has a recessed hollow section 52 which communicates with side ports 53. On the edge of the portion 51 is a spike 54.

In use, the outer housing 50 operates in a similar manner to the outer housings 1, 31 except that when an inner container, such as the inner container 41 or the inner container 11, is pushed onto the central portion 51, the sealing gasket 12 of the inner container seals against the outside of the ports 53 and subsequent to this, the spike 54 punctures the membrane 13. Hence, when the inner container is in a position similar to the position shown in FIGS. 2 and 4, the membrane 13 is ruptured but ports 53 are sealed by gasket 12 to prevent fluid from inside the inner container escaping from the inner container. When the cap 61 on the first container 60 is removed, the inner container will move to a similar position to that shown in FIG. 3. This will result in the gasket 12 uncovering ports 53 and fluid from inside the inner container will flow out of the inner container through ports 53 which direct the fluid into the main body of the first container 60.

The outer housing 50 has the advantage that it directs fluid from the inner container into the main body of the first container 60 and onto the surface of liquid contents in the first container 60.

In the examples described above, the inner containers may be secured to the cap of the first container, for example, by putting blown polyethylene foam on the upper end of the inner containers and welding the blown polyethylene foam to blown polyethylene foam on the inside top of the cap of the first container by ultrasonic welding. Other possibilities include friction fitting the inner container to a hollow cap which is then secured to the inside of the cap of the first container.

Modifications and improvements may be incorporated without departing from the scope of the invention.

I claim:

1. Apparatus for introducing a fluid into a first liquid, the apparatus comprising a first container for holding the first liquid, the first container having an opening closed by a releasable closure, and a second container located in the first container adjacent the opening of the first container; the second container comprising an outer housing located in the opening and an inner container containing a fluid, the inner container including a rupturable member and being movably mounted in the housing for movement between a closed position in which the inner container is sealed by the housing when the releasable closure closes the opening, and an open position in which the fluid within the inner container is released from the inner container into the first container and into contact with the first liquid on release of the releasable closure, the housing also including a rupturing member to rupture the rupturable member on the inner container.

2. Apparatus according to claim 1, whereby on closing of the first container by the closure, the inner container is moved to the closed position and the second container includes a sealing device and when the inner container is in the closed position, the rupturable member is ruptured by the rupturing member and the contents of the inner container prevented from being released from the inner container by the sealing member.

3. Apparatus according to claim 2, wherein the sealing member is mounted on the inner container and seals against the rupturing member on the housing.

4. Apparatus according to claim 1, wherein the rupturable member includes a fluid port through which the fluid passes when the second container moves to the open position.

5. Apparatus according to claim 1, wherein the second container includes a conduit into which the fluid passes on release of the closure and the conduit extends below the surface of the first liquid in the first container.

6. Apparatus according to claim 5, wherein the conduit extends to at least adjacent to the mid section of the first liquid in the first container.

7. Apparatus according to claim 6, wherein the conduit extends to adjacent the bottom of the first container.

8. Apparatus according to claim 1, wherein the fluid comprises a gas.

9. Apparatus according to claim 1, wherein the fluid comprises a second liquid.

10. Apparatus according to claim 1, wherein the fluid is pressurised.

* * * * *